United States Patent [19]

Landis et al.

[11] Patent Number: 4,967,030

[45] Date of Patent: Oct. 30, 1990

[54] HYDROCRACKING HIGH VISCOSITY SYNTHETIC LUBRICANT

[75] Inventors: Michael E. Landis, Woodbury; Bruce P. Pelrine, Trenton, both of N.J.; Tsoung Y. Yan, Philadelphia, Pa.

[73] Assignee: Mobil Oil Corporation, New York, N.Y.

[21] Appl. No.: 367,995

[22] Filed: Jun. 19, 1989

[51] Int. Cl.[5] ..... C07C 1/00; C07C 4/02

[52] U.S. Cl. ..... 585/241; 585/329; 585/648

[58] Field of Search ..... 585/241, 329, 648

[56] References Cited

U.S. PATENT DOCUMENTS 4,906,799 3/1990 Forbus et al. ..... 585/648

*Primary Examiner*—Curtis R. Davis

*Attorney, Agent, or Firm*—Alexander J. McKillop; Charles J. Speciale; Malcolm D. Keen

[57] ABSTRACT

It has been discovered that low viscosity lubricant can be prepared in high yield by catalytically cracking higher molecular weight oligomers of $C_6$–$C_{20}$ alpha-olefins prepared by oligomerization in contact with reduced chromium oxide catalyst on solid support. Further, it has been discovered that the reduced viscosity oligomers produced by cracking of high vicosity lubricant retains the superior characteristics of higher viscosity index and low pour point of the liquid lubricant starting material. The lubricants are cracked in contact with hydrogen and hydrocracking catalyst such as platinum or palladium on mildly acidic support. The support can be $Al_2O_3$, acidified $Al_2O_3$, $SiO_2$, $SiO_2/Al_2O_3$, zeolites comprising high silica ZSM-5, Beta, HY, USY, and clay. The reduced viscosity material is hydrotreated during cracking.

22 Claims, 1 Drawing Sheet

HYDROCRACKING HIGH VISCOSITY SYNTHETIC LUBRICANT

This invention relates to novel processes for the production of lubricant compositions. The invention, more particularly, relates to novel synthetic lubricant compositions prepared from alpha-olefins, or 1-alkenes. The invention specifically relates to the production of novel low viscosity synthetic lubricant compositions from 1-alkene oligomers by hydrocracking higher molecular weight lubricant to produce lubricants which maintain the superior viscosity indices and other improved characteristics of the higher viscosity lubricating oil feedstock.

BACKGROUND OF THE INVENTION

The improvement of lubricants beyond the performance of natural mineral oil based lubricants by the synthesis of oligomeric hydrocarbon fluids has been the subject of important research and development in the petroleum industry for at least fifty years and has led to the relatively recent market introduction of a number of superior polyalphaolefin synthetic lubricants, primarily based on the oligomerization of alpha-olefins or 1-alkenes. In terms of lubricant property improvement, the thrust of the industrial research effort on synthetic lubricants has been toward fluids exhibiting useful viscosities over a wide range of temperature, i.e., improved viscosity index, while also showing lubricity, thermal and oxidative stability and pour point equal to or better than mineral oil. These new synthetic lubricants lower friction and hence increase mechanical efficiency across the full spectrum of mechanical loads. In the prior art, oligomers of 1-alkenes from $C_6$ to $C_{20}$ have been prepared with commercially useful synthetic lubricants from 1-decene oligomerization yielding a distinctly superior lubricant product via either cationic or Ziegler catalyzed polymerization.

One characteristic of the molecular structure of 1-alkene oligomers that has been found to correlate very well with improved lubricant properties in commercial synthetic lubricants is the ratio of methyl to methylene groups in the oligomer. The ratio is called the branch ratio and is calculated from infra red data as discussed in "Standard Hydrocarbons of High Molecular Weight", *Analytical Chemistry,* Vol.25, no.10, p.1466 (1953). Viscosity index has been found to increase with lower branch ratio. Heretofore, oligomeric liquid lubricants exhibiting very low branch ratios have not been synthesized from 1-alkenes. For instance, oligomers prepared from 1-decene by either cationic polymerization or Ziegler catalyst polymerization have branch ratios of greater than 0.20. Shubkin, Ind. Eng. Chem. Prod. Res. Dev. 1980, 19, 15-19, provides an explanation for the apparently limiting value for branch ratio based on a cationic polymerization reaction mechanism involving rearrangement to produce branching. Other explanations suggest isomerization of the olefinic group in the one position to produce an internal olefin as the cause for branching. Whether by rearrangement, isomerization or a yet to be elucidated mechanism, it is clear that in the art of 1-alkene oligomerization to produce synthetic lubricants as practiced to-date, branching constrains the limits of achievable lubricant properties, particularly with respect to viscosity index.

Recently, novel lubricant compositions (referred to herein as HVI-PAO) comprising polyalpha-olefins and methods for their preparation and employing reduced chromium on a silica support as catalyst have been disclosed in U.S. patent application Ser. Nos. 210,434 and 210,435 filed June 23, 1988, incorporated herein by reference. These novel lubricants exhibit high viscosity indices with low pour point. The compositions are characterized by a uniform molecular structure with low branch ratios comprising $C_{30}$–$C_{1300}$ hydrocarbons with a branch ratio of less than 0.19. High yields are achieved in the oligomerization process for novel lubricant oligomers with viscosities above 20 cS at 100° C. However, to produce lubricant with viscosity between 2 and 40 cS directly from the oligomerization of 1-alkene, high oligomerization temperatures are required. This results in both rapid catalyst deactivation and an increase in the yield of those oligomeric species, such as dimers of 1-alkenes, whose molecular weight is too low for lubricant use. Accordingly, the desirable lubricant with low viscosity is produced in relatively low yield and shortened catalyst life, compromising the economic viability of the direct synthesis route for low viscosity HVI-PAO product. Yet, the lower viscosity range of lubricants is a very important segment of the overall lubricant market that must be serviced with an economical product, preferably one possessing the advantageous features of HVI-PAO.

Accordingly, it is an object of the present invention to provide a method for the preparation of low viscosity range HVI-PAO in high yield from high viscosity HVI-PAO.

It is another object of the present invention to provide a method for the preparation of low viscosity HVI-PAO in high yield from high viscosity HVI-PAO while retaining the high viscosity index and pour point characteristics of the novel oligomer.

Yet another object of the present invention is to prepare low viscosity HVI-PAO from high viscosity HVI-PAO by catalytically cracking of the high viscosity HVI-PAO oligomer.

SUMMARY OF THE INVENTION

It has been discovered that low viscosity HVI-PAO can be prepared in high yield by catalytically cracking of higher molecular weight HVI-PAO oligomers. Further, it has been discovered that the reduced viscosity HVI-PAO produced by cracking of higher viscosity HVI-PAO retains the superior characteristics of high viscosity index and low pour point of the liquid lubricant starting material.

More particularly, a process has been discovered for the production of high viscosity index, low pour point, low viscosity liquid hydrocarbon lubricant which comprises, first contacting $C_6$–$C_{20}$ 1-alkene feedstock with reduced valence state chromium oxide catalyst on porous silica support under oligomerizing conditions in an oligomerization zone whereby high viscosity, high VI liquid hydrocarbon lubricant is produced having branch ratio less than 0.19. The high viscosity lube is next contacted with hydrocracking catalyst and hydrogen under hydrocracking conditions in a hydrocracking zone. The hydrocracking zone effluent is separated and reduced viscosity liquid hydrocarbon lubricant having high VI is finally recovered.

The hydrocracking catalyst for the process comprises Group VIII metal on low acidity support. The catalyst can be platinum or palladium on a support such as $Al_2O_3$, acidified $Al_2O_3$, $SiO_2$, $SiO_2/Al_2O_3$, zeolites comprising high silica ZSM-5, Beta, HY, USY, and clay.

DESCRIPTION OF THE FIGURE

The Figure is a plot of lube viscosity versus yield for hydrocracking of HVI-PAO lubricant.

DETAILED DESCRIPTION OF THE INVENTION

Figure 1:
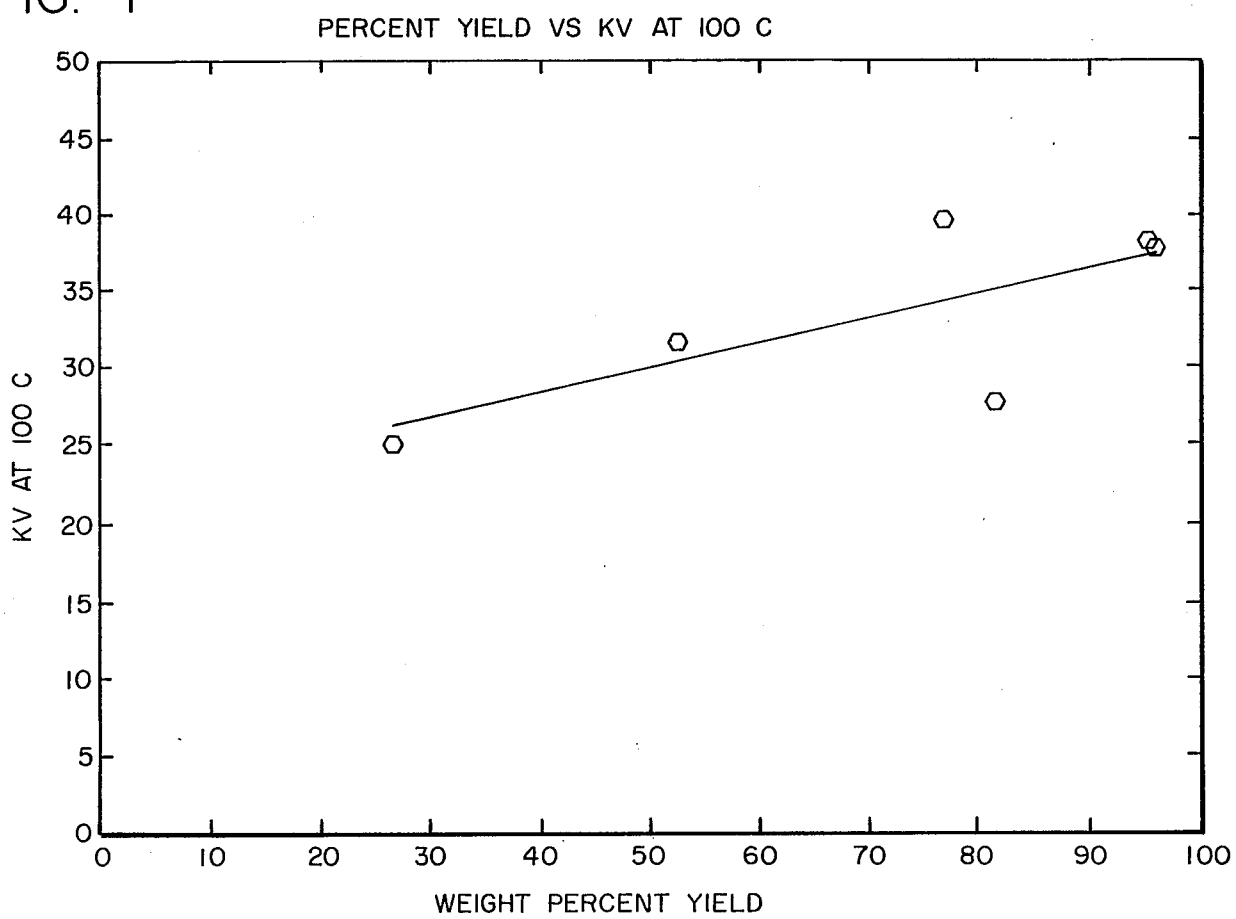

In the following description all references to HVI-PAO oligomers or lubricants as oligomerized refer to unhydrogenated or unsaturated oligomers and lubricants. In keeping with the practice well known to those skilled in the art of lubricant production, following oligomerization or viscosity reduction, the products are typically hydrogenated to convert to stable lube products. As oligomerized, HVI-PAO oligomers are mixtures of dialkyl vinylidenic and 1,2 dialkyl or trialkyl mono-olefins. In the process of the present invention, hydrocracking HVI-PAO in the presence of hydrogen results in hydrogenation of olefinic bonds providing a product of stable and reduced viscosity useful as a lubricant without further hydrogenation.

The new class of alpha-olefin oligomers used as starting material for viscosity reduction by hydrocracking to low viscosity lubricants in the present invention are prepared by oligomerization reactions in which a major proportion of the double bonds of the alpha-olefins are not isomerized. These reactions include alpha-olefin oligomerization by supported metal oxide catalysts, such as Cr compounds on silica or other supported IUPAC Periodic Table Group VIB compounds. The catalyst most preferred is a lower valence Group VIB metal oxide on an inert support. Preferred supports include silica, alumina, titania, silica alumina, magnesia and the like. The support material binds the metal oxide catalyst. Those porous substrates having a pore opening of at least 40 angstroms are preferred.

The support material usually has high surface area and large pore volumes with average pore size of 40 to about 350 angstroms. The high surface area is beneficial for supporting a large amount of highly dispersive, active chromium metal centers and to give maximum efficiency of metal usage, resulting in very high activity catalyst. The support should have large average pore openings of at least 40 angstroms, with an average pore opening of >60 to 300 angstroms preferred. This large pore opening will not impose any diffusional restriction of the reactant and product to and away from the active catalytic metal centers, thus further optimizing the catalyst productivity. Also, for this catalyst to be used in fixed bed or slurry reactor and to be recycled and regenerated many times, a silica support with good physical strength is preferred to prevent catalyst particle attrition or disintegration during handling or reaction.

The supported metal oxide catalysts are preferably prepared by impregnating metal salts in water or organic solvents onto the support. Any suitable organic solvent known to the art may be used, for example, ethanol, methanol, or acetic acid. The solid catalyst precursor is then dried and calcined at 200° to 900° C. by air or other oxygen-containing gas. Thereafter the catalyst is reduced by any of several various and well known reducing agents such as, for example, CO, $H_2$, $NH_3$, $H_2S$, $CS_2$, $CH_3SCH_3$, $CH_3SSCH_3$, metal alkyl containing compounds such as $R_3Al$, $R_3B$,$R_2Mg$, RLi, $R_2Zn$, where R is alkyl, alkoxy, aryl and the like. Preferred are CO or $H_2$ or metal alkyl containing compounds. Alternatively, the Group VIB metal may be applied to the substrate in reduced form, such as CrII compounds. The resultant catalyst is very active for oligomerizing olefins at a temperature range from below room temperature to about 250° C., but preferably from about 90° C. to about 250° C., at a pressure of 0.1 atmosphere to 5000 psi. Contact time of both the olefin and the catalyst can vary from one second to 24 hours. The catalyst can be used in a batch type reactor or in a fixed bed, continuous-flow reactor.

In general the support material may be added to a solution of the metal compounds, e.g., acetates or nitrates, etc., and the mixture is then mixed and dried at room temperature. The dry solid gel is purged at successively higher temperatures to about 600° C. for a period of about 16 to 20 hours. Thereafter the catalyst is cooled down under an inert atmosphere to a temperature of about 250° to 450° C. and a stream of pure reducing agent is contacted therewith for a period when enough CO has passed through to reduce the catalyst as indicated by a distinct color change from bright orange to pale blue. Typically, the catalyst is treated with an amount of CO equivalent to a two-fold stoichiometric excess to reduce the catalyst to a lower valence CrII state. Finally the catalyst is cooled down to room temperature and is ready for use.

The product oligomers have a very wide range of viscosities with high viscosity indices suitable for high performance lubrication use. The product oligomers also have atactic molecular structure of mostly uniform head-to-tail connections with some head-to-head type connections in the structure. These low branch ratio oligomers have high viscosity indices at least about 15 to 20 units and typically 30–40 units higher than equivalent viscosity prior art oligomers, which regularly have higher branch ratios and correspondingly lower viscosity indices. These low branch oligomers maintain better or comparable pour points.

The branch ratios defined as the ratios of $CH_3$ groups to $CH_2$ groups in the lube oil are calculated from the weight fractions of methyl groups obtained by infrared methods, published in *Analytical Chemistry*, Vol. 25, No. 10, p. 1466 (1953).

$$\text{Branch ratio} = \frac{\text{wt fraction of methyl group}}{1 - (\text{wt fraction of methyl group})}$$

It has been found that the process described herein to produce the novel HVI-PAO oligomers can be controlled to yield oligomers having weight average molecular weight between 300 and 45,000 and number average molecular weight between 300 and 18,000. Measured in carbon numbers, 1 molecular weights range from $C_{30}$ to $C_{1300}$ and viscosity up to 750 cs at 100° C., with a preferred range of $C_{30}$ to $C_{1000}$ and a viscosity of up to 500 cs at 100° C. Molecular weight distributions (MWD), defined as the ratio of weight average molecular to number average molecular weight, range from 1.00 to 5, with a preferred range of 1.01 to 3 and a more preferred MWD of about 1.05 to 2.5. Compared to conventional PAO derived from BF3 or $AlCl_3$ catalyzed polymerization of 1-alkene, HVI-PAO of the present invention has been found to have a higher proportion of higher molecular weight polymer molecules in the product. Viscosities of the novel HVI-PAO oligomers measured at 100° C. range from 3 cS to 5000 cS.

The following examples show the preparation of the HVI-PAO starting material used in the present invention. They are presented merely for illustration purposes and are not intended to limit the scope of the present invention.

EXAMPLE 1

Catalyst Preparation and Activation Procedure 1.9 grams of chromium (II) acetate ($Cr2(OCOCH_3)_42H_2O$) (5.58 mmole) (commercially obtained) is dissolved in 50 cc of hot acetic acid. Then 50 grams of a silica gel of 8–12 mesh size, a surface area of 300 $m^2/g$, and a pore volume of 1 cc/g, also is added. Most of the solution is absorbed by the silica gel. The final mixture is mixed for half an hour on a rotavap at room temperature and dried in an open-dish at room temperature. First, the dry solid (20 g) is purged with $N_2$ at 250° C. in a tube furnace. The furnace temperature is then raised to 400° C. for 2 hours. The temperature is then set at 600° C. with dry air purging for 16 hours. At this time the catalyst is cooled down under $N_2$ to a temperature of 300° C. Then a stream of pure CO (99.99% from Matheson) is introduced for one hour. Finally, the catalyst is cooled down to room temperature under $N_2$ and ready for use.

EXAMPLE 2

The catalyst prepared in Example 1 (3.2 g 0) is packed in a ⅜" stainless steel tubular reactor inside an $N_2$ blanketed dry box. The reactor under $N_2$ atmosphere is then heated to 150° C. by a single-zone Lindberg furnace. Pre-purified 1-hexene is pumped into the reactor at 140 psi and 20 cc/hr. The liquid effluent is collected and stripped of the unreacted starting material and the low boiling material at 0.05 mm Hg. The residual clear, colorless liquid has viscosities and VI's suitable as a lubricant base stock.

| Sample | Prerun | 1 | 2 | 3 |
|---|---|---|---|---|
| T.O.S., hr. | 2 | 3.5 | 5.5 | 21.5 |
| Lube Yield, wt % | 10 | 41 | 74 | 31 |
| Viscosity, cS, at | | | | |
| 40° C. | 208.5 | 123.3 | 104.4 | 166.2 |
| 100° C. | 26.1 | 17.1 | 14.5 | 20.4 |
| VI | 159 | 151 | 142 | 143 |

EXAMPLE 3

Similar to Example 2, a fresh catalyst sample is charged into the reactor and 1-hexene is pumped to the reactor at 1 atm and 10 cc per hour. As shown below, a lube of high viscosities and high VI's is obtained. These runs show that at different reaction conditions, a lube product of high viscosities can be obtained.

| Sample | A | B |
|---|---|---|
| T.O.S., hrs. | 20 | 44 |
| Temp., °C. | 100 | 50 |
| Lube Yield, % | 8.2 | 8.0 |
| Viscosities, cS at | | |
| 40° C. | 13170 | 19011 |
| 100° C. | 620 | 1048 |
| VI | 217 | 263 |

EXAMPLE 4

A commercial chrome/silica catalyst which contains 1% Cr on a large-pore volume synthetic silica gel is used. The catalyst is first calcined with air at 800° C. for 16 hours and reduced with CO at 300° C. for 1.5 hours. Then 3.5 g of the catalyst is packed into a tubular reactor and heated to 100° C. under the $N_2$ atmosphere. 1-Hexene is pumped through at 28 cc per hour at 1 atmosphere. The products are collected and analyzed as follows:

| Sample | C | D | E | F |
|---|---|---|---|---|
| T.O.S., hrs. | 3.5 | 4.5 | 6.5 | 22.5 |
| Lube Yield, % | 73 | 64 | 59 | 21 |
| Viscosity, cS, at | | | | |
| 40° C. | 2548 | 2429 | 3315 | 9031 |
| 100° C. | 102 | 151 | 197 | 437 |
| VI | 108 | 164 | 174 | 199 |

These runs show that different Cr on a silica catalyst are also effective for oligomerizing olefins to lube products.

EXAMPLE 5

As in Example 4, purified 1-decene is pumped through the reactor at 250 to 320 psi. The product is collected periodically and stripped of light products boiling points below 650° F. High quality lubes with high VI are obtained (see following table).

| Reaction | WHSV | Lube Product Properties | | |
|---|---|---|---|---|
| Temp. °C. | g/g/hr | KV at 40° C. | KV at 100° C. | VI |
| 120 | 2.5 | 1555.4 cs | 157.6 cs | 217 |
| 135 | 0.6 | 389.4 | 53.0 | 202 |
| 150 | 1.2 | 266.8 | 39.2 | 185 |
| 166 | 0.6 | 67.7 | 12.3 | 181 |
| 197 | 0.5 | 21.6 | 5.1 | 172 |

Olefins suitable for use as starting material to prepare HVI-PAO used as starting material in the invention include those olefins containing from 2 to about 20 carbon atoms such as ethylene, propylene, 1-butene, 1-pentene, 1-hexene, 1-octene, 1-decene, 1-dodecene and 1-tetradecene and branched chain isomers such as 4-methyl-1-pentene. Also suitable for use are olefin-containing refinery feedstocks or effluents. However, the olefins used in this invention are preferably alpha olefinic as for example 1-hexene to 1-hexadecene and more preferably 1-octene to 1-tetradecene, or mixtures of such olefins.

Direct synthesis of low viscosity fluids from alpha olefins with supported metal oxide catalysts generally suffers from low yield of trimer and higher poly-1-olefins due to the characteristic molecular weight distribution of the oligomers produced by this type of catalysis. Specifically, in the production of low viscosity polyalpha-olefin fluids by supported metal oxide catalysis, large amounts of dimer can be formed which must be removed from the remainder of the liquid oligomer products if these fluids are to have the desirable volatility and pour point characteristics required of most liquid lubricant basestocks and blended lubricants. Production of substantial amounts of dimer with the trimer and higher oligomer products naturally reduces the amount of liquid products appropriate for lubricant basestocks.

In general polyalpha-olefin fluids, consisting of trimer and higher oligomers, with kinematic viscosities of 20 cS at 100° C. can be produced by direct synthesis in a minimum of 90% yield based upon the starting 1-olefins feed. Production of lower viscosity homologues results in lower yield because of increased dimer product. This invention improves the overall yield of trimer and higher oligomer products based upon amount of starting olefin by taking high viscosity HVI-PAO fluids, synthesized by the method described above and obtainable in high yields, and catalytically cracking these fluids to lower viscosity homologous fluids.

The catalyst used in the present invention to accomplish the hydrocracking of HVI-PAO is generally a catalyst made of precious metals. Typical catalysts include precious metals or other metals from Group VIII from the periodic table. These metals are deposited on mild to low acidity supports. Preferred metals include platinum and palladium. The preferred supports include $Al_2O_3$, acidified $Al_2O_3$, $SiO_2$, $SiO_2/Al_2O_3$, zeolites comprising high silica ZSM-5, Beta, HY, USY, and clay. Using the aforestated catalyst on mild to low acidity supports heavy or high viscosity HVI-PAO is catalytically hydrocracked under mild conditions to produce light or low viscosity HVI-PAO. The hydrocracking is accomplished in the presence of or in contact with hydrogen. The overall result, in addition to hydrocracking of the HVI-PAO, is to produce a stable light HVI-PAO product where the double bonds have been hydrogenated in the course of the hydrocracking step. The product recovered therefore comprises a stable hydrotreated HVI-PAO product of lower viscosity.

In the following Examples 6–11, the catalyst used comprises platinum on a low acidity silica/alumina support. The catalyst is used in an extruded form of 1/16" diameter. The catalyst was reduced in hydrogen at 450 psig and 350° C. overnight. Approximately 10 cc of catalyst is used in a fixed-bed reactor. Table 1 illustrates the characteristics of the catalyst.

TABLE 1

| CATALYST CHARACTERIZATION PT/SILICA/ALUMINA | |
|---|---|
| SURFACE AREA, SQ. METER/GRAM | 377 |
| REAL DENSITY, GRAM/CC | 2.26 |
| PARTICLE DENSITY, GRAM/CC | 0.94 |
| PORE VOLUME, CC/GRAM | 0.63 |
| PLATINUM, WEIGHT % | 0.88 |

The synthetic HVI-PAO lubricant which served as a feedstock in Example 6–11 was prepared by the process described above and had a viscosity of 48.5 cS measured at 100° C. and a viscosity index (VI) of 189.6.

Table 2 shows the details of the experimental results. All runs were made at about 1 liquid hourly space velocity (LHSV) and reaction temperatures between 285° C. (545° F.) and 313° C. (595° F.). The reactor pressure was maintained at 450 psig with a hydrogen flow rate of 2500 SCF/BBL. Each total-liquid-product in each Example was distilled at about 1 mm Hg at a head temperature of about 200° C. to remove light material.

In each Example there is evidence of a reduction in the product viscosity relative to the feed as can be seen in Table 2. At the bottom of Table 2 are calculated the viscosity reduction in percent when the viscosities are measured at 100° C. The range of viscosity reduction is between 18.1% and 48%. In terms of kinematic viscosity, the reduction is from 48.5 cS (at 100 C) to 39.7 cS and 25.2 cS, respectively.

Also shown in Table 2 are the yields of the viscosity reduced synthetic lubricants. These yields are plotted as a function of viscosity in FIG. 1. FIG. 1 shows that there is a relationship between the yield and the resulting viscosity. As the yield of the product is reduced by more severe crackin9, the viscosity of the product correspondingly decreases.

TABLE 2

| EXPERIMENTAL DETAILS AND PRODUCT PROPERTIES | | | | | | | |
|---|---|---|---|---|---|---|---|
| EXAMPLE | FEED | 6 | 7 | 8 | 9* | 10** | 11 |
| TEMPERATURE, °C. | | 285 | 313 | 292 | 310 | 310 | 308 |
| PRESSURE PSIG | | 450 | 450 | 450 | 450 | 450 | 450 |
| LHSV | | 1.0 | 0.8 | 0.8 | 0.8 | 0.8 | 0.8 |
| YIELD-% | | 94.9 | 26.0 | 76.6 | 95.2 | 82.0 | 53.1 |
| KV, 40° C. | 380.7 | 316.5 | 202.1 | 360.7 | 308.4 | 221.3 | 272.4 |
| KV, 100° C. | 48.5 | 37.9 | 25.2 | 39.7 | 37.4 | 27.6 | 31.6 |
| VISC. INDEX | 189.6 | 169.9 | 156.2 | 166.2 | 171.3 | 161.1 | 157.4 |
| % VISC. REDUC. (100° C.) | | 21.9 | 48.0 | 18.1 | 22.9 | 43.1 | 34.8 |

*Reduced catalyst at 350° C. overnight prior to Example 9.
**Reduced catalyst at 400° C. overnight prior to Example 10.

The process of the instant invention can be carried out at temperatures between 100° C. and 500° C. However, it is preferred to carry out the hydrocracking at a temperature between 250° and 350° C. The HVI-PAO feedstock LHSV can be between about 0.1 and 10, with a preferred feedstock LHSV between about 0.4 and 4.0. The pressure in the hydrocracking zone can be between about 50 and 2000 psig, with a pressure of about 100–1000 psig, with 450 psig preferred. The hydrogen flow rate in the hydrocracking zone should be between about 500 and 3500 SCF/B, with a hydrogen flow rate of about 1000–2500 SCF/B preferred.

Following the hydrocracking reaction of high viscosity HVI-PAO the effluent from the hydrocracking zone is separated to recover the lower viscosity HVI-PAO. Generally, separation includes distillation to remove lower boiling non-lube grade fractions and recover low viscosity HVI-PAO. It is particularly surprising in the instant invention that the hydrocracking process described is accomplished without deleteriously affecting the VI of HVI-PAO. The higher viscosity or heavier HVI-PAO is reduced to a lower viscosity or lighter HVI-PAO which still maintains the high VI of the feedstock. In addition to being hydrocracked the light HVI-PAO has been affectively hydrotreated which eliminates the need for a further hydrogenation step to produce stable lube product.

While the invention has been described by specific examples and embodiments, there is no intent to limit the inventive concept except as set forth in the following claims.

What is claimed is:

1. A process for the production of high viscosity index, low viscosity hydrocarbon lubricant from higher viscosity liquid hydrocarbon lubricant feedstock, comprising:

contacting said feedstock with hydrocracking catalyst and hydrogen under hydrocracking conditions in a hydrocracking zone, said feedstock having a viscosity index greater than 130, branch ratio below 0.19 and comprising the product of the oligomerization of $C_6$ to $C_{20}$ alpha-olefin feedstock, or mixtures thereof, under oligomerization conditions in contact with a reduced valence state Group VIB metal catalyst on porous support; and separating reduced viscosity, high VI liquid lubricant homologues of said lubricant feedstock in high yield.

2. The process of claim 1 wherein said hydrocracking conditions comprise temperature between about 100° and 500° C., feedstock LHSV between about 0.1 and 10, pressure between about 50 and 2000 psig and hydrogen flow rate between about 500 and 3500 SCF/B.

3. The process of claim 1 wherein said hydrocracking conditions comprise temperature between about 250° and 350° C., feedstock LHSV between about 0.4 and 4.0, pressure of about 450 psig, and hydrogen flow rate of about 2500 SCF/B.

4. The process of claim 1 wherein said homologues comprise liquid lubricant having a viscosity between 1 and 40 cS at 100° C. and viscosity index greater than 130.

5. The process of claim 1 wherein said hydrocracking catalyst comprises Group VIII metal on low acidity support.

6. The process of claim 5 wherein said hydrocracking catalyst comprises platinum and said support is taken from the group consisting essentially of $Al_2O_3$, acidified $Al_2O_3$, $SiO_2$, $SiO_2/Al_2O_3$, zeolites comprising high silica ZSM-5, Beta, HY, USY, and clay.

7. The process of claim 5 wherein said hydrocracking catalyst comprises palladium and said support is taken from the group consisting essentially of $Al_2O_3$, acidified $Al_2O_3$, $SiO_2$, $SiO_2/Al_2O_3$, zeolites comprising high silica ZSM-5, Beta, HY, USY, and clay.

8. The process of claim 1 wherein said feedstock comprises a liquid lubricant composition comprising $C_{30}$–$C_{1300}$ hydrocarbons, said composition having a branch ratio of less than 0.19, weight average molecular weight between 600 and 45,000, number average molecular weight between 600 and 18,000, molecular weight distribution between 1 and 5 and pour point below −15° C.

9. The process of claim 1 wherein said oligomerization conditions comprise temperature between 90° and 250° C. and feedstock to catalyst weight ratio between 10:1 and 300:1; and said reduced valence state catalyst comprises CO reduced $CrO_3$ on silica support, said support having a pore size of at least 40 Angstroms.

10. The process of claim 1 wherein said alpha-olefin is selected from 1-octene, 1-decene, 1-dodecene, and mixtures thereof.

11. The process of claim 1 wherein said olefin is 1-decene.

12. A process for the production of high viscosity index, low viscosity liquid hydrocarbon lubricant, comprising:

contacting $C_6$–$C_{20}$ 1-alkene feedstock with reduced valence state chromium oxide catalyst on porous silica support under oligomerizing conditions in an oligomerization zone whereby high viscosity, high VI liquid hydrocarbon lubricant is produced having branch ratio less than 0.19;

contacting said high viscosity lubricant with hydrocracking catalyst and hydrogen under hydrocracking conditions in a hydrocracking zone;

separating hydrocracking zone effluent and recovering reduced viscosity liquid hydrocarbon lubricant having high VI.

13. The process of claim 12 wherein said hydrocracking catalyst comprises Group VIII metal on low acidity support.

14. The process of claim 13 wherein said hydrocracking catalyst comprises platinum and said support is taken from the group consisting essentially of $Al_2O_3$, acidified $Al_2O_3$, $SiO_2$, $SiO_2/Al_2O_3$, zeolites comprising high silica ZSM-5, Beta, HY, USY, and clay.

15. The process of claim 13 wherein said hydrocracking catalyst comprises palladium and said support is taken from the group consisting essentially of $Al_2O_3$, acidified $Al_2O_3$, $SiO_2$, $SiO_2/Al_2O_3$, zeolites comprising high silica ZSM-5, Beta, HY, USY, and clay.

16. The process of claim 12 wherein the viscosity of said high viscosity liquid lubricant is greater than 20 cS at 100° C.; and said reduced viscosity liquid lubricant viscosity is between 2 and 40 cS at 100° C. with VI greater than 130.

17. The process of claim 12 wherein said hydrocracking conditions comprise temperature between about 100° and 500° C., feedstock LHSV between about 0.1 and 10, pressure between about 50 and 2000 psig and hydrogen flow rate between about 500 and 3500 SCF/B.

18. The process of claim 12 wherein said hydrocracking conditions comprise temperature between about 275° and 325° C., feedstock LHSV between about 0.8 and 1.0, pressure of about 450 psig, and hydrogen flow rate of about 2500 SCF/B.

19. The process of claim 12 wherein said oligomerization conditions comprise temperature between 90° and 250° C. and feedstock to catalyst weight ratio between 10:1 and 300:1; said catalyst comprises CO reduced $CrO_3$ and said support comprises silica having a pore size of at least 40 Angstroms.

20. The process of claim 12 wherein said 1-alkene is selected from 1-octene, 1-decene, 1-dodecene, and mixtures thereof.

21. The process of claim 12 wherein said 1-alkene is 1-decene.

22. The process of claim 1 or 12 wherein said hydrocracking conditions comprise hydrocracking and hydrotreating conditions and said reduced viscosity lubricant comprises hydrogenated lubricant.

* * * * *